US011462091B2

(12) United States Patent
Hall

(10) Patent No.: US 11,462,091 B2
(45) Date of Patent: Oct. 4, 2022

(54) ANTI-LIGATURE DEVICE

(71) Applicant: KINGSWAY ENTERPRISES (UK) LIMITED, Swanley (GB)

(72) Inventor: Benjamin Hall, Swanley (GB)

(73) Assignee: Kingsway Enterprises (UK) Limited, Kent (GB)

( * ) Notice: Subject to any disclaimer, the term of this patent is extended or adjusted under 35 U.S.C. 154(b) by 0 days.

(21) Appl. No.: 17/691,465

(22) Filed: Mar. 10, 2022

(65) Prior Publication Data

US 2022/0198899 A1 Jun. 23, 2022

Related U.S. Application Data

(63) Continuation of application No. 17/515,867, filed on Nov. 1, 2021.

(30) Foreign Application Priority Data

Nov. 26, 2020 (GB) ..... 2018613
Jun. 25, 2021 (GB) ..... 2109187

(51) Int. Cl.
*G08B 21/02* (2006.01)
*E06B 7/28* (2006.01)

(52) U.S. Cl.
CPC ..... *G08B 21/02* (2013.01); *E06B 7/28* (2013.01)

(58) Field of Classification Search
None
See application file for complete search history.

(56) References Cited

U.S. PATENT DOCUMENTS

| | | | |
|---|---|---|---|
| 3,868,000 | A | 2/1975 | Spear et al. |
| 4,115,952 | A | 9/1978 | French |
| D268,809 | S | 5/1983 | Marontate |
| 4,675,659 | A | 6/1987 | Jenkins, Jr. et al. |
| 4,920,241 | A | 4/1990 | Miller |
| D309,869 | S | 8/1990 | Dunmore |
| 5,027,552 | A | 7/1991 | Miller et al. |
| D322,634 | S | 12/1991 | Callas |
| D323,788 | S | 2/1992 | Roberts et al. |
| D325,355 | S | 4/1992 | Meguerdichian et al. |
| 5,240,349 | A | 8/1993 | Kennedy et al. |

(Continued)

FOREIGN PATENT DOCUMENTS

| | | |
|---|---|---|
| AT | 414005 B | 8/2006 |
| CA | 2572810 C | 1/2005 |

(Continued)

OTHER PUBLICATIONS

Great Britain Combined Search and Examination Report for GB2109187.1 dated Sep. 3, 2021.

(Continued)

*Primary Examiner* — Adolf Dsouza
(74) *Attorney, Agent, or Firm* — Erise IP, P.A.

(57) ABSTRACT

An anti-ligature device for attachment to an edge of a door leaf, the anti-ligature device having a proximity sensor arranged to detect a ligature secured around the anti-ligature device. The proximity sensor may be arranged to detect a weight being suspended from a ligature secured around the anti-ligature device. The sensitivity of the proximity sensor may be user-controllable, such that the anti-ligature device can be calibrated once affixed to the door leaf.

20 Claims, 9 Drawing Sheets

(56) References Cited

U.S. PATENT DOCUMENTS

| | | | |
|---|---|---|---|
| D425,810 | S | 5/2000 | Siller et al. |
| 6,080,981 | A | 6/2000 | Payne |
| D449,244 | S | 10/2001 | Ginzel |
| 6,544,200 | B1 | 4/2003 | Smith et al. |
| 6,689,970 | B2 | 2/2004 | Burgess et al. |
| 6,720,874 | B2 | 4/2004 | Fufidio et al. |
| D496,577 | S | 9/2004 | Cohrs, Jr. et al. |
| 6,984,818 | B1 | 1/2006 | Breed et al. |
| 7,024,823 | B2 | 4/2006 | Keller |
| 7,116,072 | B1 | 10/2006 | Murray et al. |
| 7,118,141 | B2 | 10/2006 | Cohrs, Jr. et al. |
| 7,132,642 | B2 | 11/2006 | Shank et al. |
| 7,373,694 | B1 | 5/2008 | Kopp |
| 7,603,813 | B2 | 10/2009 | Hackl |
| 7,999,690 | B1 | 8/2011 | Shilts |
| RE42,991 | E | 12/2011 | Cook |
| RE44,039 | E | 3/2013 | Cook |
| 8,646,206 | B2 | 2/2014 | Gilchrist |
| D743,290 | S | 11/2015 | Welch et al. |
| 2004/0030531 | A1 | 2/2004 | Miller et al. |
| 2006/0192396 | A1* | 8/2006 | Frolov ..... E05B 45/12 292/169 |
| 2010/0102978 | A1 | 4/2010 | Wittke |
| 2010/0194563 | A1 | 8/2010 | Berner et al. |
| 2010/0325967 | A1 | 12/2010 | Pearson et al. |
| 2010/0325980 | A1 | 12/2010 | Gilchrist |
| 2011/0068927 | A1 | 3/2011 | Berger |
| 2019/0266862 | A1* | 8/2019 | Harrison ..... G08B 21/0461 |
| 2020/0208459 | A1 | 7/2020 | Trobro et al. |
| 2021/0189767 | A1 | 6/2021 | Hall |
| 2021/0225142 | A1 | 7/2021 | Izod et al. |

FOREIGN PATENT DOCUMENTS

| | | | |
|---|---|---|---|
| CN | 1346327 | A | 4/2002 |
| CN | 203961709 | U | 11/2014 |
| CN | 205604875 | U | 9/2016 |
| CN | 107890217 | A | 4/2018 |
| CN | 207651827 | U | 7/2018 |
| CN | 108388296 | A | 8/2018 |
| CN | 207813257 | U | 9/2018 |
| CN | 208030656 | U | 11/2018 |
| CN | 209444091 | U | 9/2019 |
| DE | 3007170 | A1 | 9/1981 |
| DE | 3706624 | A1 | 9/1987 |
| DE | 19638359 | A1 | 4/1998 |
| DE | 202005012636 | U1 | 12/2006 |
| EP | 1051695 | A1 | 11/2000 |
| FI | 116408 | B | 11/2005 |
| FR | 2759804 | A1 | 8/1998 |
| FR | 3066218 | A1 | 11/2018 |
| GB | 2276659 | A | 10/1994 |
| GB | 2435992 | A | 9/2007 |
| GB | 2435994 | A | 9/2007 |
| GB | 2435993 | A | 9/2009 |
| GB | 4030455 | | 6/2013 |
| GB | 2564733 | A | 1/2019 |
| JP | H1076843 | A | 3/1998 |
| JP | 2000009554 | A | 1/2000 |
| JP | 20000057881 | A | 2/2000 |
| JP | 3271917 | B2 | 4/2002 |
| JP | 2004162401 | A | 6/2004 |
| JP | 2005120653 | A | 5/2005 |
| JP | 2006266018 | A | 10/2006 |
| JP | 2006274590 | A | 10/2006 |
| JP | 2007154561 | A | 6/2007 |
| JP | 4263978 | B2 | 5/2009 |
| JP | 4435534 | B2 | 3/2010 |
| WO | 2019220089 | A1 | 11/2019 |

OTHER PUBLICATIONS

Keller, "Inpatient Suicide Prevention," Joint Commission Journal on Quality and Patient Safety/Joint Commission Resources, Jul. 2008.

Yeager, et al. "Measured Response to Identified Suicide Risk and Violence: What You Need to Know about Psychiatric Patient Safety," Published by Oxford University Press, 2005.

"Instastop Door Top Alarm" available Aug. 22, 2019, [online], [site visited Aug. 22, 2019]. Retrieved from Internet, URL: https://anti-ligature-shop.co.uk/product/intastop-door-top-alarm/ (Year: 2019).

"Kingsway KG500 Anti Ligature door top monitor". available Aug. 22, 2019, [online], [site visited Aug. 22, 2019]. Retrieved from Internet, URL:https://anti-ligature-shop.co.uk/product/kingsway-kg500-anti-ligature- -door-top-monitor/ (Year: 2019).

"Piedmont Door Solutions" available Aug. 22, 2019, [online], [site visited Aug. 22, 2019]. Retrieved from Internet, URL: http://www.piedmontdoorsolutions.com/products/anti-ligature-solutions- / (Year: 2019).

Great Britain Patent Application 191884.6 Combined Search and Examination Report dated Jun. 3, 2020.

Baumer, Inductive Proximity Switch, IFFM 08P17A6/L, Dec. 18, 2016.

Great Britain Patent Application GB1918884.6 Search Report dated Jan. 13, 2021.

Great Britain Patent Application 2110845.1 Combined Search and Examination Report dated Aug. 24, 2021.

Canadian Patent Application 3089499 Office Action dated Jan. 27, 2022.

Great Britain Patent Application GB1916899.6 Combined Search and Examination Report dated May 19, 2020.

* cited by examiner

ANTI-LIGATURE DEVICE

RELATED APPLICATIONS

The present application is a continuation of U.S. patent application Ser. No. 17/515,867, filed Nov. 1, 2021, which claims priority to Great Britain Patent Application No. 2018613.6, filed Nov. 26, 2020, and Great Britain Patent Application 2109187.1, filed Jun. 25, 2021, the disclosures of which are incorporated by reference into the present application in its entirety.

FIELD

The present disclosure relates to an anti-ligature device for attachment to an edge of a door leaf.

BACKGROUND

In psychiatric hospitals and prisons, a problem exists that patients and inmates may wish to cause themselves harm using a ligature created by securing a rope or cable around an available anchor point in a room. One solution to this problem is to design room fixtures and fittings such that they do not provide such anchor points. However, in some cases this is difficult or impossible. An example of this is door fittings. Individuals may try to create a ligature by securing a rope or cable around an edge of a door leaf.

One solution is to attach a device which includes a ribbon switch to an edge (e.g. top edge) of a door leaf. When a ligature is secured around the device, the ribbon switch is caused to close, thereby completing an electrical circuit and activating an alert. Accordingly, while the door leaf may itself remain a potential ligature hazard, safety is nonetheless improved because a nearby prison officer or healthcare professional is alerted when an individual attempts to secure a ligature around the door leaf. Unfortunately, however, this solution is imperfect. Sensitivity of the ligature detection is non-adjustable. Additionally, the ligature detection can in some cases be unreliable.

SUMMARY

The present disclosure has been developed to address at least some of the problems noted above.

In a first aspect there is provided an anti-ligature device for attachment to an edge of a door leaf, the anti-ligature device comprising a proximity sensor arranged to detect a ligature secured around the anti-ligature device. For example, the proximity sensor may be arranged to detect a weight being suspended from a ligature secured around the anti-ligature device.

When the anti-ligature device is secured along an edge (e.g. top edge, bottom edge, or closing edge) of a door leaf, it enables a ligature secured around the edge of the door leaf to be detected. By using a proximity sensor, rather than a ribbon switch (or indeed any type of mechanical switch), sensitivity is improved. In fact, because the output of the sensor may be non-binary, the sensitivity of the device may be adjustable. That is to say, the sensitivity may be user-controllable, such that the anti-ligature device can be calibrated once affixed to a door leaf. This improves reliability. The fact that there are no moving parts to the proximity sensor itself also improves reliability and durability.

The proximity sensor may be a sensor that is configured to detect the presence of a nearby object (for example a target) without requiring any physical contact between the sensor and the nearby object. The proximity sensor may be any of an electromagnetic proximity sensor (for example infrared proximity sensor); an inductive proximity sensor; a capacitive proximity sensor; or a photoelectric proximity sensor.

The proximity sensor may be configured to operate in combination with a target. For example, the proximity sensor may be configured to detect changes in proximity of the target (e.g. changes in distance between the target and the proximity sensor). In some examples, the anti-ligature device may comprise a target opposing the proximity sensor, wherein the target is moveable relative to (e.g. towards or away from) the proximity sensor when a ligature is secured around the anti-ligature device, and wherein the proximity sensor is configured to detect a change in proximity of the target. Where the target is moveable towards the proximity sensor when a ligature is secured around the device, the target may be resiliently biased away from the proximity sensor. Similarly, where the target is moveable away from the proximity sensor when a ligature is secured around the device, the target may be resiliently biased towards the proximity sensor.

Where the proximity sensor is a capacitive proximity sensor or a photoelectric proximity sensor, the target may comprise a range of materials, such as plastic, ceramic, and/or metal. The target may be plastic to save construction costs; or may be metal for durability. Where the proximity sensor is an electromagnetic (e.g. infrared) proximity sensor, the target may be formed of any material that is opaque to the electromagnetic radiation used by the proximity sensor. For example, the target may be metal. Where the proximity sensor is an inductive proximity sensor, the target may be an electrical conductor, e.g. a metal target, such as an aluminium target. As the reader will understand, other metals such as steel or copper could be used for the target.

The target may be moveable between a first position in which it is separated from the proximity sensor by a first distance, and a second position in which it is separated from the proximity sensor by a second distance. The proximity sensor may be configured to detect when the separation between the target and the proximity sensor crosses a predetermined threshold distance. One of the first and second distances may be larger than the threshold distance, and the other of the first and second distances may be smaller than the threshold distance. The target may be resiliently biased into one of the first position and the second position. The target may be moveable into the other of the first position and the second position when a ligature is secured around the anti-ligature device.

For example, the target may be moveable between a first position in which it is spaced from the proximity sensor, and a second position in which the target is substantially adjacent the proximity sensor. The target may be resiliently biased into the first position. The target may be moveable into the second position when a ligature is secured around the anti-ligature device.

The travel of the target may be limited. For example, the first and second positions may comprise respective limits to the target's travel. For example, the anti-ligature device may comprise a surface for preventing movement of the target past the first position. Abutment between the first and second parts may prevent movement of the target past the second position.

The proximity sensor may be housed within the anti-ligature device. The target may be housed within the anti-ligature device. Accordingly, tampering of the anti-ligature device may be prevented, thus improving safety. Durability may also be improved.

The anti-ligature device may be compressible to thereby move the target relative to the proximity sensor. For example, anti-ligature device may be configured such that a ligature being secured around the anti-ligature device causes a compression of the anti-ligature device, thereby moving the target relative to the proximity sensor as described above. In some examples, the anti-ligature device may comprise a compressible enclosure, wherein the proximity sensor is attached to an inner surface of the enclosure, and wherein the target is attached to the inner surface of the enclosure so as to oppose the proximity sensor. In some examples, a portion of the enclosure opposing the proximity sensor may comprise the target.

The anti-ligature device may comprise a first part for attachment to a door leaf, and a second part coupled with the first part; wherein the proximity sensor is connected to one of the first part and the second part; and the other of the first part and the second part comprises the target.

In some examples, the anti-ligature device which comprises a first part for attachment to a door leaf; a second part coupled with the first part; and a proximity sensor attached to the first part; wherein the second part comprises a target arranged to oppose the proximity sensor; and wherein the second part is moveable relative to (e.g. towards and away from) the first part. The second part may be configured to move relative to the first part when a ligature is secured around the device. Movement of the second part relative to the first part may thereby be detectable by the proximity sensor.

In some examples, the target may be attached to the second part. In other examples, the second part may comprise the target. For example, where the second part is plastic, it may constitute a suitable target for use with a capacitive proximity sensor or a photoelectric proximity sensor. Where the second part is metal, it may constitute a suitable target for use with any type of proximity sensor. In one example, an inductive proximity sensor is used in combination with a second part that is metal, e.g. aluminium.

The first and second parts may collectively form an enclosure within which the target and the proximity sensor are located.

The second part may be configured to float relative to the first part. Accordingly, the second part may be moveable relative to (e.g. towards and away from) the first part. Accordingly, the target is thereby moveable relative to the proximity sensor (e.g. between the first and second positions).

The second part may be resiliently biased into one of the first position and the second position. The second part may be moveable into the other of the first position and the second position when a ligature is secured around the device (or when a weight is suspended from a ligature secured around the device). That is to say, the second part may be resiliently biased into a position in which the target is in one of the first position and the second position; and may be moveable into a position in which the target is in the other of the first position and the second position.

In an example, the second part is resiliently biased into the first position, i.e. into a position in which the target is spaced from the proximity sensor. The second part is then moveable into the second position, i.e. into a position in which the target adjacent the proximity sensor.

The second part may be coupled to the first part in such a way that its travel relative to the first part (and hence the target's travel relative to the proximity sensor) is limited. In particular, the second part may be coupled to the first part such that the second part cannot move further from the first part than the first position.

The anti-ligature device may be elongate. For example, each of the first and second parts may be elongate. The device may thereby be configured for attachment along at least a portion of an edge of a door leaf.

The anti-ligature device may comprise an opening for receiving a lock element. For example, the second part may comprise an opening for receiving a lock element. The first part may also comprise an opening for receiving the lock element. The opening in the second part may be aligned with the opening in the first part. The lock element may be an electromagnetic lock element (e.g. electromagnetic lock plate), or a mechanical lock element (e.g. lock bolt).

The anti-ligature device may comprise an electromagnetic lock element. The electromagnetic lock element may extend through an opening in the second part. The electromagnetic lock element may be coupled to the first part. Alternatively, the anti-ligature device may comprise openings in both the first part and the second part, to receive a mechanical lock element therethrough.

The anti-ligature device may comprise more than one proximity sensor, such as two proximity sensors, or four proximity sensors, or more than four proximity sensors. For example, the device may comprise a first proximity sensor at a first end thereof, and a second proximity sensor at a second end thereof. The device may comprise a first proximity sensor at a first lateral edge thereof, and a second proximity sensor at a second lateral edge thereof. In some examples, the device may comprise an inductive pressure sensor at each corner of the anti-ligature device. Accordingly, the anti-ligature device may comprise a first target located at the first end of the device to oppose the first proximity sensor; and a second target located at the second end of the device to oppose the second proximity sensor. In examples in which the second part of the anti-ligature device is used in lieu of a separate target, the second part may comprise both the first and second targets.

The (or each) proximity sensor may be configured to produce an analog electrical output having a signal characteristic (e.g. amplitude and/or frequency) that is indicative of a separation distance from the target. For example, an amplitude of the electrical output may be inversely proportional to the separation distance from the target. That is to say, as the separation distance decreases, the amplitude of the electrical output may increase. In another example, the proximity sensor may comprise internal circuitry configured to produce a binary output indicative of the separation distance. The binary output may be an electrical output. Alternatively, the binary output may be a provided by a LED. Where the output is a binary output, the proximity sensor may be configured to provide a first binary output (e.g. 'off' or 'zero') when the separation distance from the target is equal to or greater than a threshold distance; and to provide a second binary output (e.g. 'on' or 'one') when the separation distance from the target is less than the threshold distance. Where the proximity sensor is configured to provide a binary output, the threshold distance may be user configurable.

The (or each) proximity sensor may be connected to an alarm system. The alarm system may be configured to receive and process the output from the (or each) proximity sensor. The alarm system may be configured to activate an alarm when at least one of the or each proximity sensors indicates that a ligature is secured around the anti-ligature device. For example, the alarm system may be configured to activate an alarm when the output from at least one of the or each proximity sensors is indicative of the separation distance from the target being below the threshold distance.

In some examples, the alarm system may be housed within the anti-ligature device. In other examples, the alarm system may be external from the anti-ligature device. Where the alarm system is external to the anti-ligature device, it may be connected to the anti-ligature device by a wired connection, or a wireless connection. For example, the wireless connection may be a wireless personal area network "PAN" connection (such as Bluetooth), a wireless local area network "LAN" connection (such as WiFi), or a wireless wide area network "WAN" connection (such as Cellular).

In some examples, the sensitivity of the alarm may be user adjustable by changing the threshold at which the alarm is activated. The alarm may comprise a notification, e.g. an SMS message, email, or other computer notification. In other examples, the alarm may comprise a buzzer. In other examples, the alarm may comprise a light, for example an LED. Where the alarm system is separate from the anti-ligature device, it may be located at a remote location, for example a nurses' station.

In a second aspect there is provided a door leaf comprising an anti-ligature device according to the first aspect. The anti-ligature device may extend along at least a portion of the edge. In some examples, the anti-ligature device may extend along substantially the entire edge. The door leaf may comprise a first anti-ligature device according to the first aspect attached to a first edge thereof; and a second anti-ligature device according to the first aspect attached to a second edge thereof. In another example, the door leaf may comprise a first anti-ligature device according to the first aspect attached to a first edge thereof; a second anti-ligature device according to the first aspect attached to a second edge thereof; and a third anti-ligature device according to the first aspect attached to a third edge thereof. A hinge may be attached to a free edge (e.g. the fourth edge) of the door leaf.

In a third aspect there is provided a door system comprising a door leaf pivotally attached to a door frame, and further comprising an anti-ligature device according to the first aspect attached to one of a top edge, bottom edge, and closing edge, of the door leaf. The door system may comprise a first anti-ligature device according to the first aspect attached to a first edge of the door leaf; and a second anti-ligature device according to the first aspect attached to a second edge of the door leaf. The door system may further comprise a third anti-ligature device according to the first aspect attached to a third edge of the door leaf. The door leaf may be pivotally attached to the door frame by a hinge along the fourth edge.

The first edge may comprise one of the top edge, bottom edge, and closing edge. The second edge may comprise another of the top edge, bottom edge, and closing edge. The third edge may comprise the last of the top edge, bottom edge, and closing edge.

BRIEF DESCRIPTION OF THE DRAWINGS

Examples of the present disclosure will now be described, by way of example only, with reference to the accompanying figures, in which.

Like reference numerals are used for like components throughout the drawings and detailed description.

DETAILED DESCRIPTION

Figure 1:
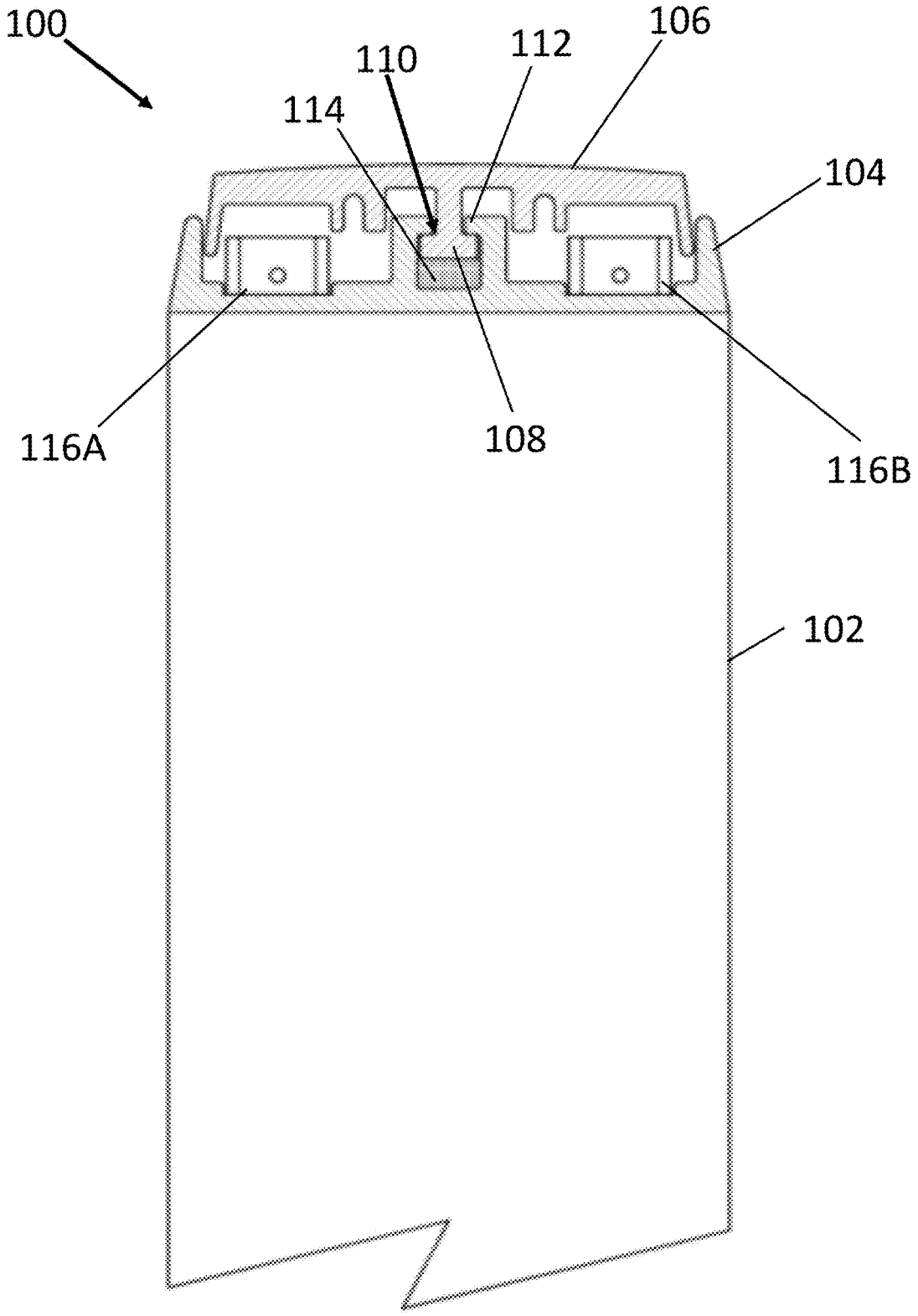
FIG. 1 shows a cross-sectional view of an anti-ligature device according to the present disclosure.

FIG. 1 shows an end view of an anti-ligature device 100 according to the present disclosure, attached to an edge of a door leaf 102. The anti-ligature device includes a first part 104 attached to the door leaf 102, and a second part 106 coupled with the first part 104. The coupling between the first part 104 and the second part 106 is such that the second part 106 floats relative to the first part 104. This is achieved by a bulbous protrusion 108 which is received within a channel 110 of the first part 104. Because of the bulbous end to the protrusion 108, the second part 106 cannot completely separate from the first part 104. In particular, the inward facing lip 112 of the channel 110 prevents separation of the second part 106 from the first part 104. Therefore, not only is the second part 106 able to float relative to the first part 104, but its movement away from the first part 104 is limited. In other words, the travel of the second part 106 relative to the first part 104 is limited.

A piece of resiliently deformable foam 114 is located within the channel 110, and arranged to bias the second part 106 away from the first part 104. Accordingly, in its rest configuration (i.e. in which no external forces are applied, such as by a ligature), as illustrated in FIG. 1, the second part 106 is spaced from the first part 104. As the user will understand, a spring could be used instead of foam.

Attached to the first part 104 of the anti-ligature device 100 are a first inductive proximity sensor 116A, and a second inductive proximity sensor 116B. The inductive proximity sensors 116A, 116B face the second part 106. The inductive proximity sensors 116A, 116B are thus configured to detect the separation distance from the second part 106. Moreover, they are configured to detect changes in the separation distance.

In effect, the second part 106 provides an inductive target for the inductive proximity sensors 116A, 116B to detect. The second part 106 is aluminium, so that it is detectable by the inductive proximity sensors 116A, 116B. As the reader will understand, any conductor could be used for the target/second part. Thus, when the second part 106 moves towards the inductive proximity sensors 116A, 116B, the inductive sensors can detect the change in separation distance from the second part 106. This is described in more detail below, in relation to FIGS. 4 and 5.

Referring still to FIG. 1, upturned edges of each of the first part 104 and the second part 106 mean that the inductive proximity sensors 116A, 116B are concealed/enclosed within the anti-ligature device 100, even when the second part 106 is spaced from the first part 104 as shown in FIG. 1.

Figure 2:
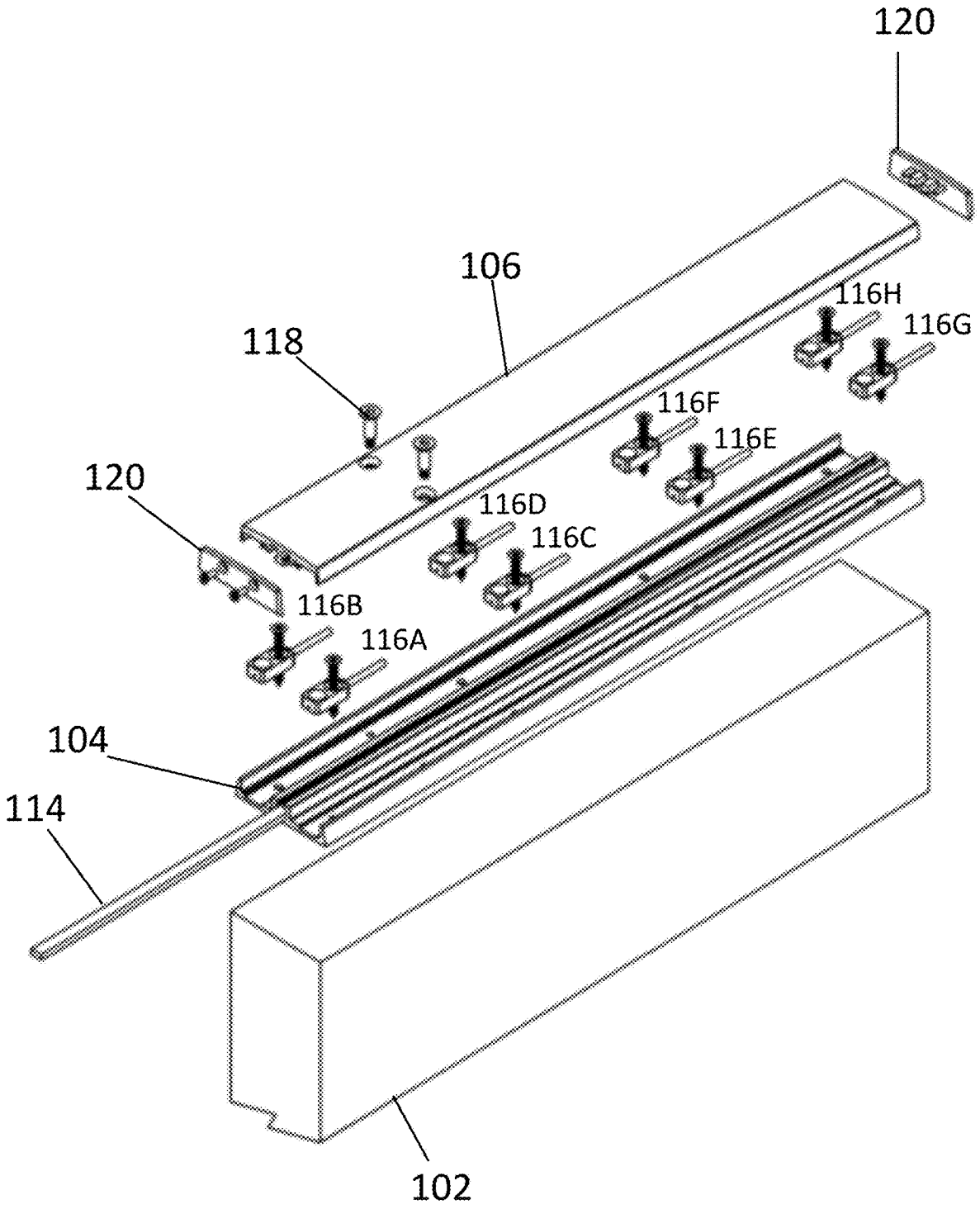
FIG. 2 shows an exploded perspective view of the anti-ligature device of FIG. 1.

FIG. 2 shows an exploded view of the anti-ligature device 100 according to the present disclosure. As can be seen from FIG. 2, the anti-ligature device 100 and its components are elongate, for attachment along the edge of the door leaf 102. Eight inductive proximity sensors 116A-116H are provided attached to the first part 104. As the reader will understand, a different number of proximity sensors could be used. Inductive proximity sensors 116A, 116C, 116E and 116G are located on a first lateral side of the anti-ligature device 100. Inductive proximity sensors 116B, 116D, 116F, 116H are located on a second lateral side of the anti-ligature device 100. Inductive proximity sensors 116A, 116B, 116C, 116D are located at a first longitudinal end of the anti-ligature device. Inductive proximity sensors 116E, 116F, 116G, 116H are located at a second longitudinal end of the anti-ligature device. Inductive proximity sensors 116B, 116A, 116H, 116G are respectively located at the four corners of the anti-ligature device 100. Screws 118 are used to secure the second part 106 to the first part 104. An end-plate 120 is affixed to each end of the anti-ligature device 100, to conceal the contents of the anti-ligature device 100.

Figure 3:
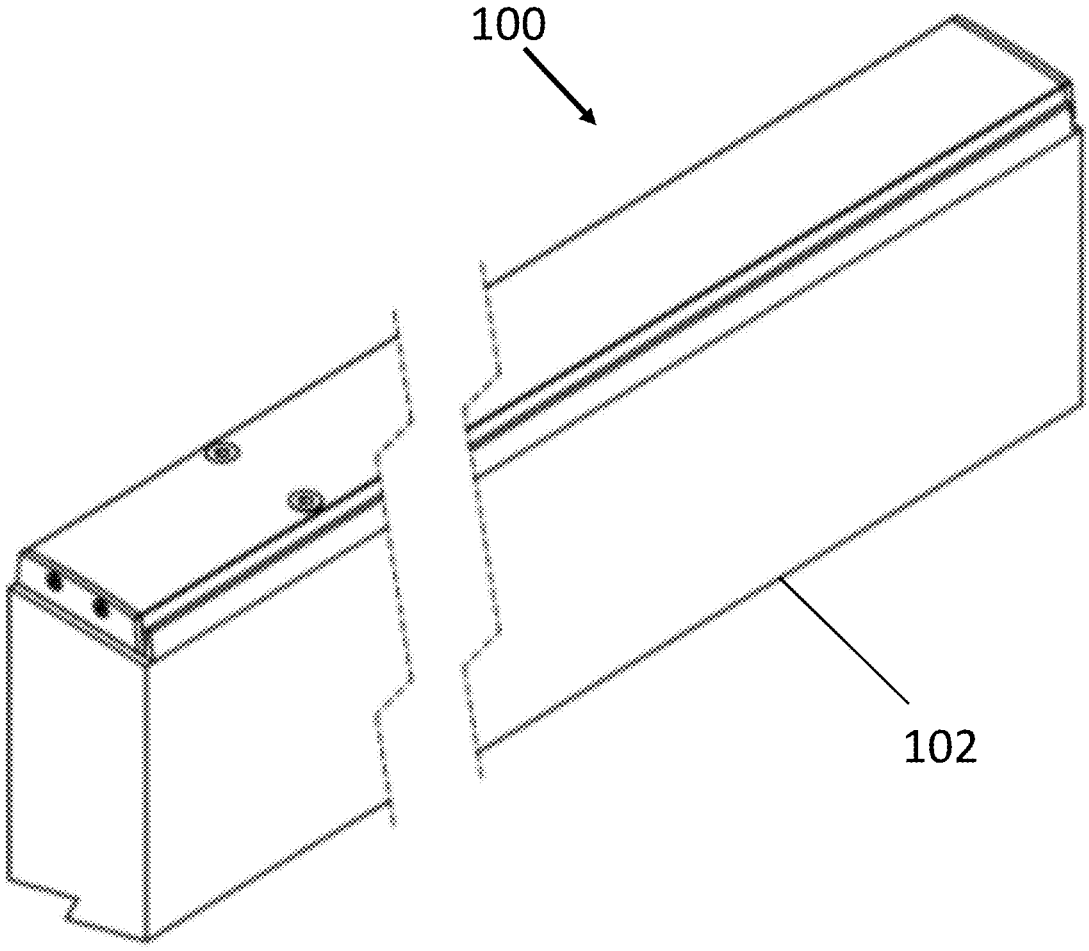
FIG. 3 shows an assembled perspective view of the anti-ligature device of FIGS. 1 and 2.

FIG. 3 shows an assembled view of FIG. 2. As can be seen, the internals of the anti-ligature device 100 are completely concealed.

Each of the first part 104 and the second part 106 have a uniform cross-section. They are aluminium, and formed by aluminium extrusion.

As the skilled person will appreciate, the anti-ligature device 100 can have a variety of dimensions, dependent on the size of the door leaf 102 to which it is to be fitted. Nonetheless, dimensions of an example anti-ligature device 100 will now be provided for illustrative purposes.

The anti-ligature device 100 of FIG. 1 has a length, in the longitudinal direction, of 1 m. That is to say, the first and second parts 104, 106 each have a length of 992 mm, such that the entire anti-ligature device 100 has a length of 1 m when the end-plates 120 are fitted.

The anti-ligature device 100 has an outer width (in the horizontal direction when fitted to a door) of 44 mm. Thus, the pressure monitor having these dimensions is particularly suited for attachment to a door leaf having an edge that is 1 m long, and a thickness of 44 mm.

In the uncompressed configuration as shown in FIG. 1, the separation distance between the inductive proximity sensors 116A, 116B and the second part 106 is 2.75 mm. Each of the inductive proximity sensors 116A, 116B is configured to detect when the separation distance from the second part 106 drops below 2 mm. For example, the sensors may activate an alert when the distance drops below 2 mm. This is described in more detail in relation to FIG. 6 below. In short, each of the inductive proximity sensors is sensitive to a movement of just 0.75 mm in the second part 106. In other words, sensitivity is high. In some examples, the sensitivity may be user-configurable to avoid false positives and false negatives. For example, the sensitivity may be calibrated once the anti-ligature device 100 has been installed.

Figure 4:
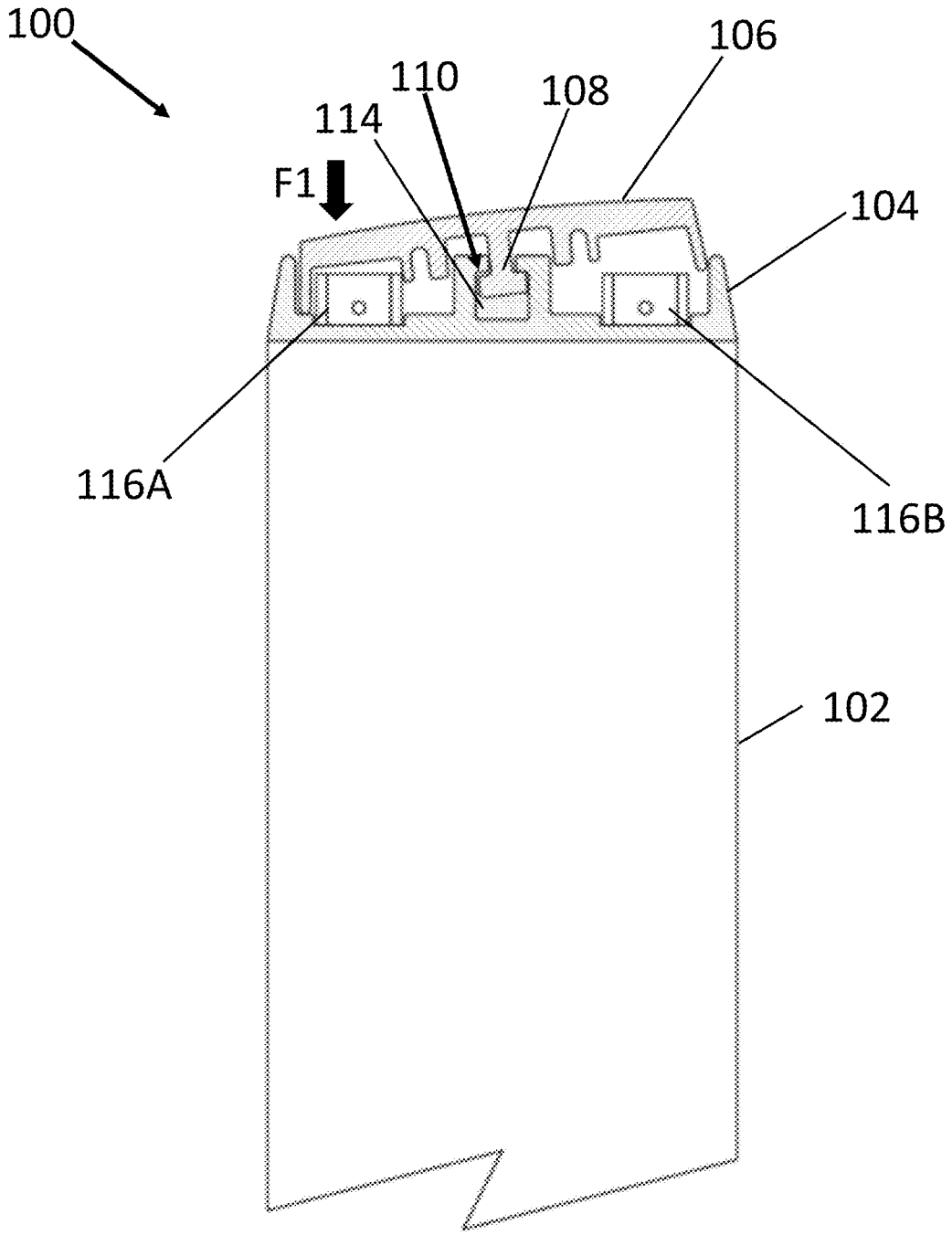
FIG. 4 shows the anti-ligature device of FIG. 1 in a first compressed state.
Figure 5:
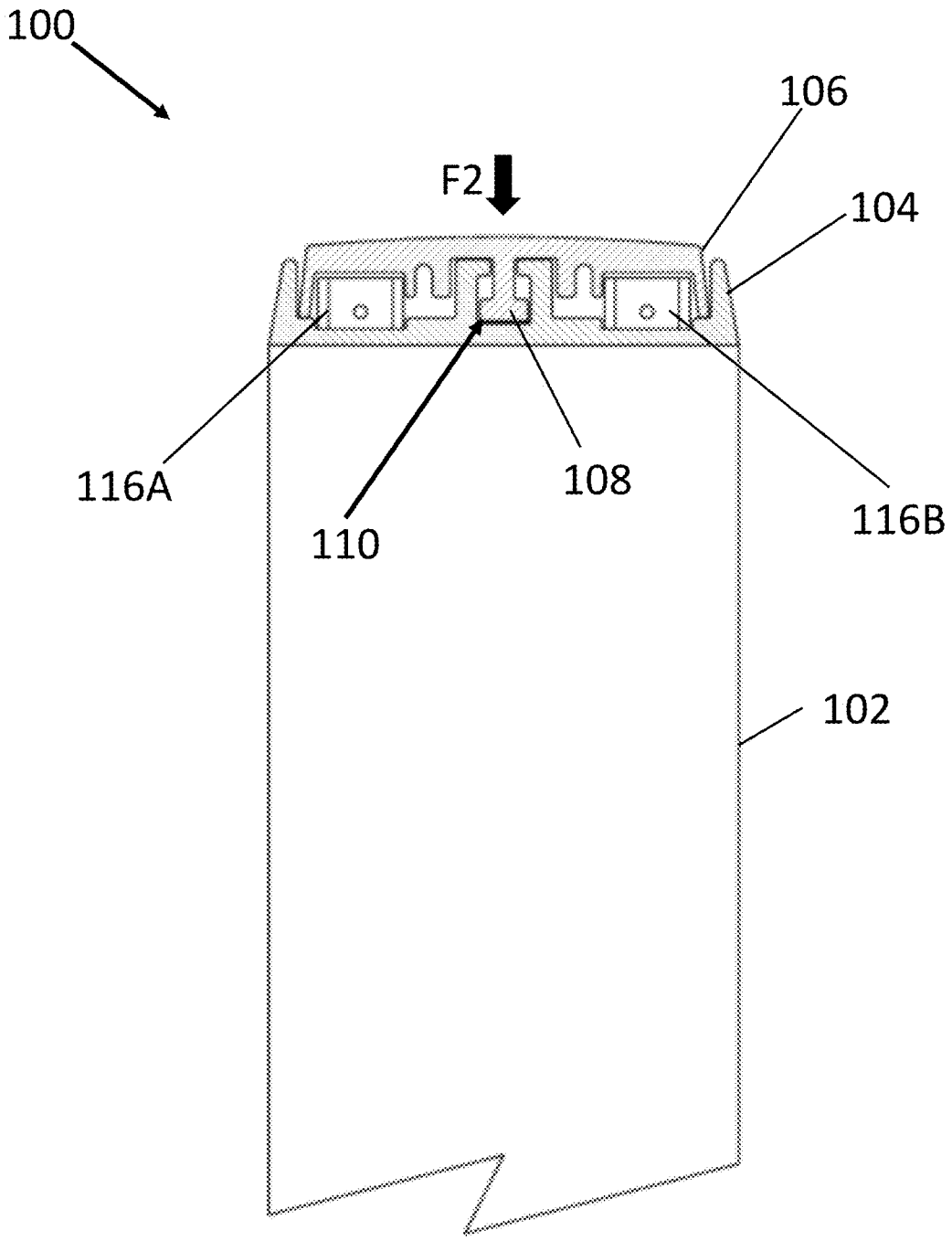
FIG. 5 shows the anti-ligature device of FIG. 1 in a second compressed state.

Referring now to FIGS. 4 and 5, when a force F1 or F2 is applied to the second part 106 (e.g. by a ligature looped around the second part 106), the second part 106 is caused to move towards the first part 104. The foam 114 is compressed, and the separation distance between the second part 106 (i.e. the target) and the inductive proximity sensor(s) decreases. Thus, the ligature can in effect be detected. As shown in FIG. 4, even if the force is unevenly applied to the second part 106, thereby resulting in an asymmetric depression of the second part 106, the first inductive proximity sensor 116A can nonetheless still detect the movement—even if the second inductive proximity sensor 116B cannot. Therefore, the anti-ligature device 100 is robust.

When the force F1 or F2 is removed, the foam will return to its original shape, thereby returning the anti-ligature device to the configuration shown in FIG. 1.

The inductive proximity sensor(s) 116 used may be IFFM 08P17A6/L inductive sensors from Baumer. The inductive proximity sensor 116 is configured to produce a binary output. In particular, each sensor is configured to activate an LED when the separation distance from the target drops below 2 mm. As the reader will understand, different proximity sensors could equally be used. Accordingly, if the separation distance between the second part 106 and any one of the inductive proximity sensors 116A-116H of FIG. 1 drops below 2 mm, the LED(s) associated with the proximity sensor(s) in question will activate.

Figure 6:
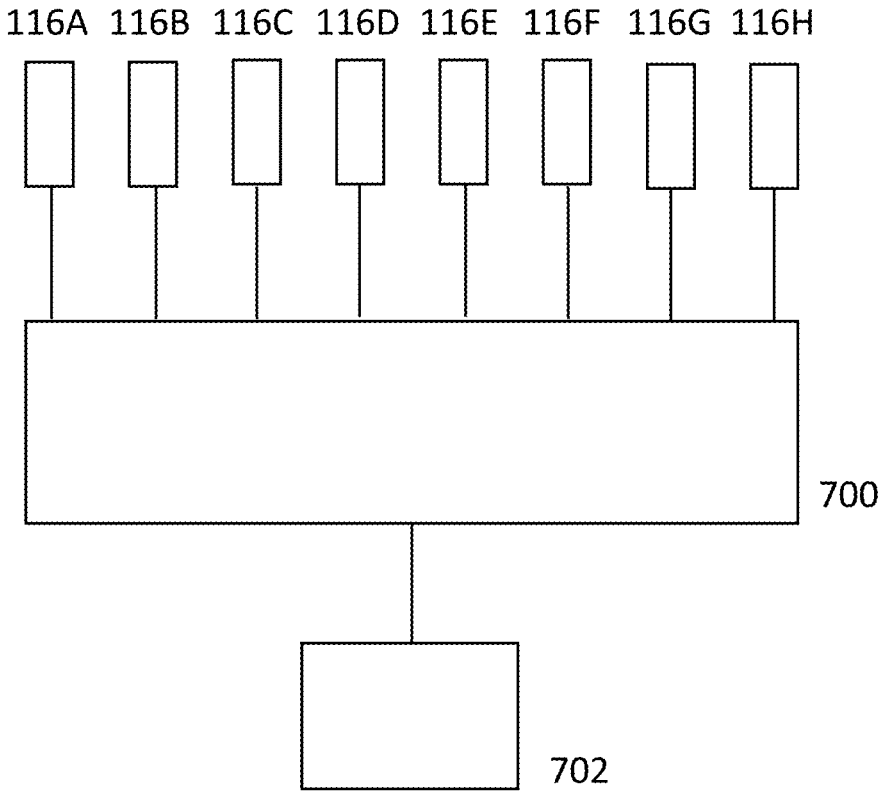
FIG. 6 shows an alarm system for use with the anti-ligature device of FIG. 1.

FIG. 6 is a schematic diagram showing an alarm system for use in with the anti-ligature device of FIG. 1. As shown, each inductive sensor 116A-116H is connected, by fibre-optic cable, to alarm processing unit 700. In effect, the alarm processing unit 700 operates as an OR gate, such that if the input from any one of the inductive sensors 116A-116H indicates that the separation distance has dropped below 2 mm (i.e. if any one of the LEDs is turned on), then a signal is issued to activate the alarm 702. The alarm processing unit may be located within the anti-ligature device 100, or may be external from the anti-ligature device 100.

Figure 7A:
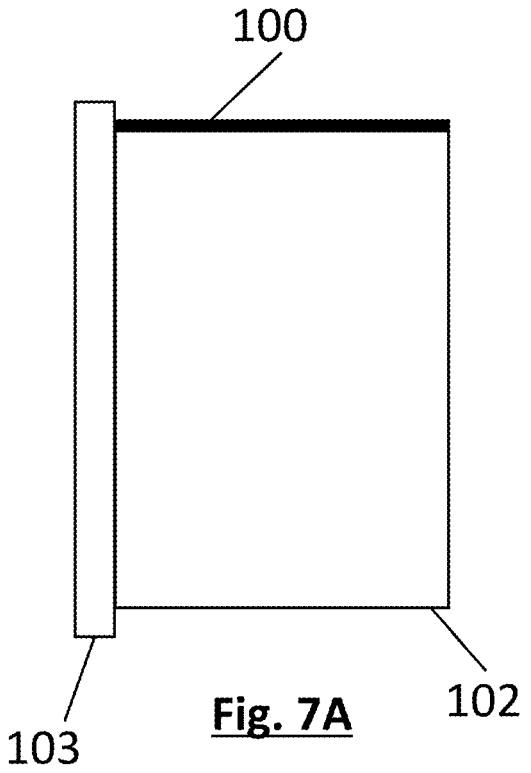
FIGS. 7A-7C show door systems according to the present disclosure.
Figure 7B:
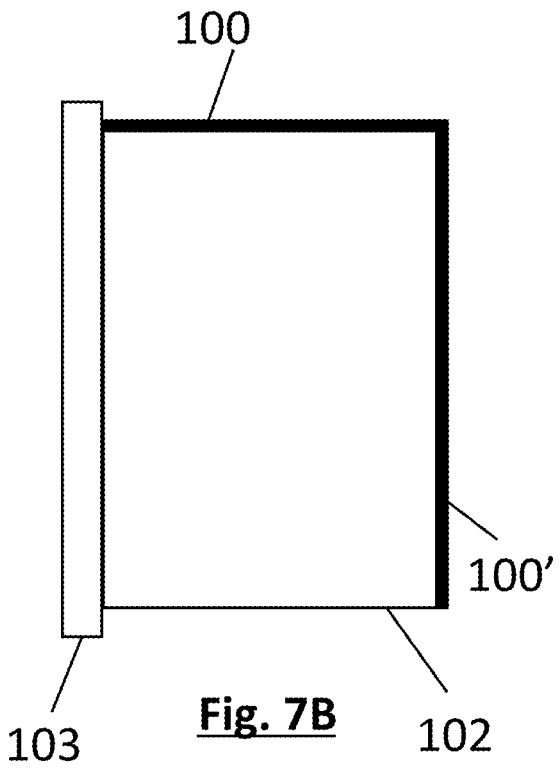
Figure 7C:
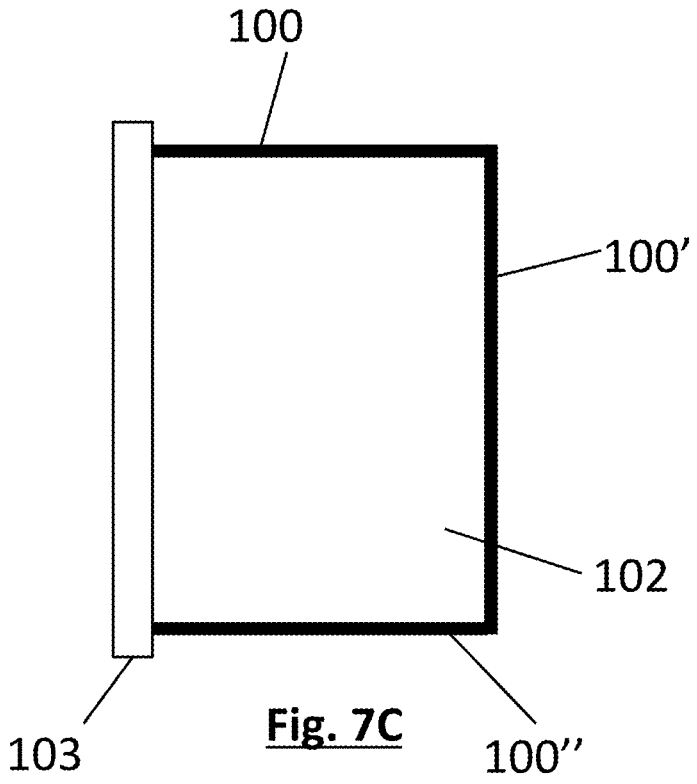

FIGS. 7A-7C show door systems according to the present disclosure. Each door system includes a door leaf 102 pivotally attached to a door frame 103. In the door system of FIG. 7A, an anti-ligature device 100 according to FIG. 1 is attached to a top edge thereof. In the door system of FIG. 7B, a first anti-ligature device 100 according to FIG. 1 is attached to a top edge thereof, and a second anti-ligature device 100' according to FIG. 1 is attached to a closing edge thereof. In the door system of FIG. 7C, a first anti-ligature device according to FIG. 1 is attached to a top edge thereof, a second anti-ligature device 100' according to FIG. 1 is attached to a closing edge thereof, and a third anti-ligature device 100" according to FIG. 1 is attached to a bottom edge thereof.

Figure 8:
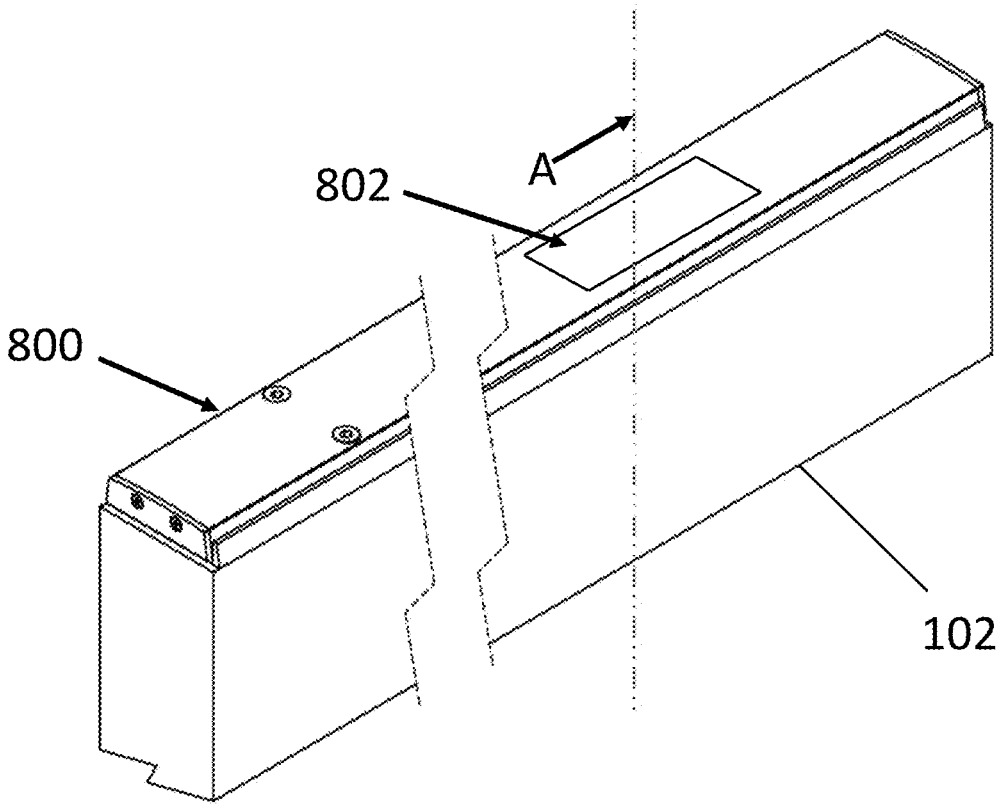
FIG. 8 shows a perspective view of a further anti-ligature device, configured for use with a lock element.

FIG. 8 shows a further example of an anti-ligature device 800 according to the present disclosure. The anti-ligature device 800 is the same in configuration and operation as the anti-ligature device 100. However, the anti-ligature device 800 further includes an opening 802 for accommodating a lock, for example an electromagnetic lock element.

Figure 9:
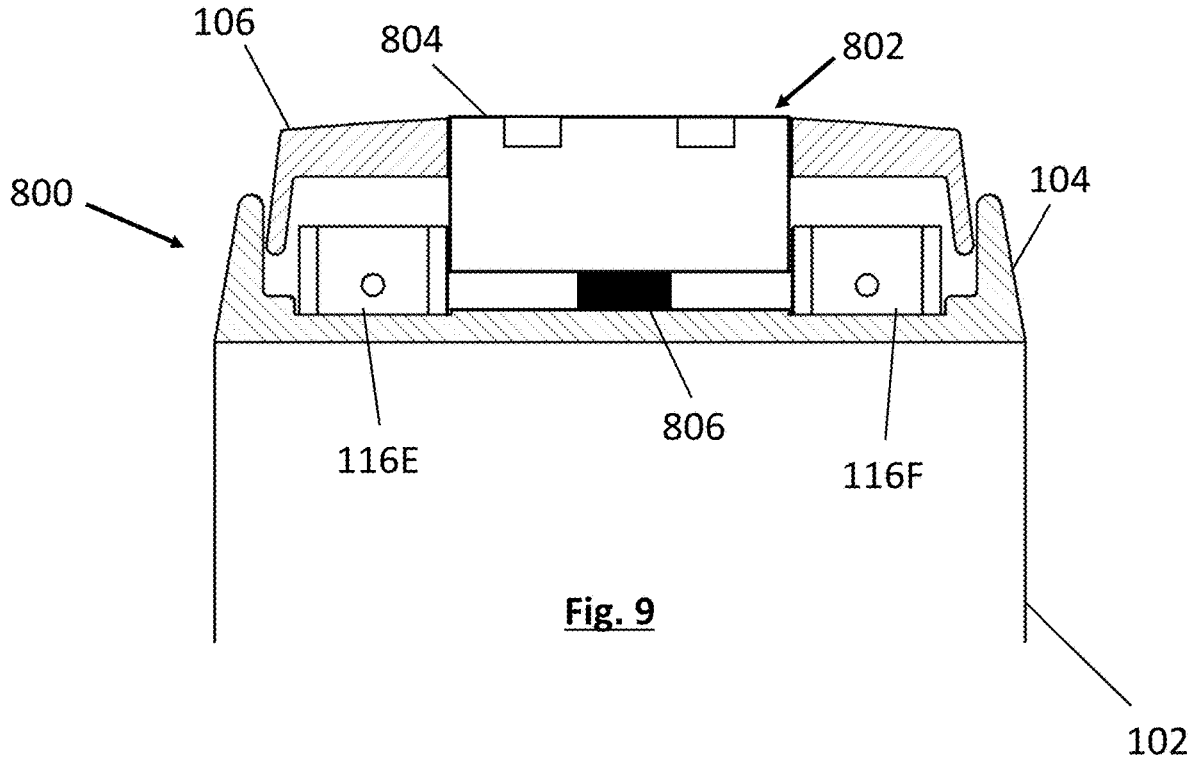
FIG. 9 shows a cross-sectional view of the anti-ligature device of FIG. 8, including an electromagnetic lock element.

FIG. 9 shows an example of the anti-ligature device 800, in which an electromagnetic lock element 804 is provided in the opening. FIG. 9 is viewed along direction A as shown in FIG. 8. The electromagnetic lock element is mounted to the base plate (first part 104). The opening 802 is provided in the surface plate (second part 106), and the electromagnetic lock plate 804 extends through the opening 802. The electromagnetic lock element may be configured to float relative to the first part 104. For example, the electromagnetic lock element may be resiliently biased away from the first part 104 by a compressible element 806, e.g. a helical spring. In use, the electromagnetic lock element 804 will be arranged to coincide with a cooperating electromagnetic lock element coupled to the adjacent door frame.

Figure 10:
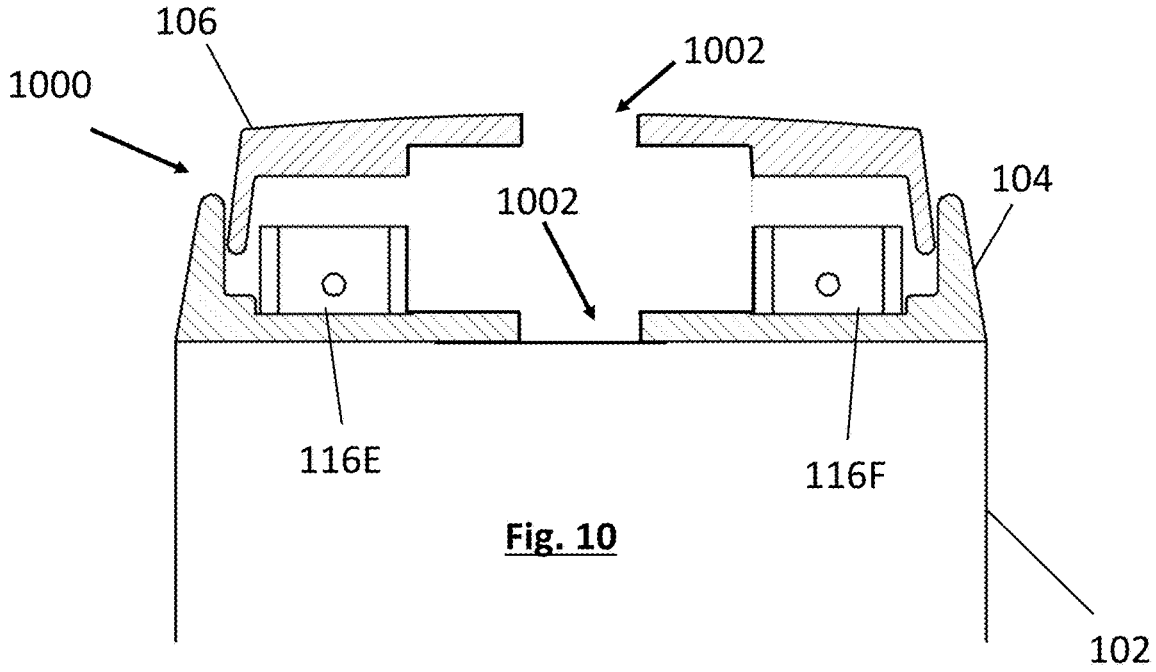
FIG. 10 shows a cross-sectional view of a further anti-ligature device, configured for use with a mechanical lock bolt.

FIG. 10 shows a further example of an anti-ligature device 1000 according to the present disclosure. Again, the anti-ligature device 1000 is the same in configuration and operation as the anti-ligature device 100. The device 1000 includes a first opening 1002*a* in the first part 104, and a second opening 1002*b* in the second part 106. The first and second openings 1002*a*, 1002*b* are aligned, so as to receive a mechanical lock bolt (not show) therethrough when the lock bolt is in a thrown position. Accordingly, a lock bolt (not shown) can be thrown through the openings 1002*a*, 1002*b* of the anti-ligature device 1000, in order to lock the door.

It is to be understood that the above description is intended to be illustrative, and not restrictive. Many other implementations will be apparent to those of skill in the art upon reading and understanding the above description. Although the present disclosure has been described with reference to a specific example implementation, it will be recognized that the disclosure is not limited to the implementations described, but can be practiced with modification and alteration insofar as such modification(s) and alteration (s) remain within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

The invention claimed is:

1. An anti-ligature device comprising:

an inductive proximity sensor; and an electrical conductor target resiliently biased away from the inductive proximity sensor;

wherein the electrical conductor target is moveable towards the inductive proximity sensor in response to a force from a ligature on the anti-ligature device;

wherein the inductive proximity sensor is configured to detect when a separation distance between the electrical conductor target and the inductive proximity sensor is less than a predetermined threshold distance to thereby detect that a ligature is applying force to the anti-ligature device.

2. The anti-ligature device according to claim 1, wherein the anti-ligature device is configured to attach to an edge of a door leaf, and the inductive proximity sensor is located within a tamper-resistant housing.

3. The anti-ligature device according to claim 1, wherein the electrical conductor target is resiliently biased away from the inductive proximity sensor via either foam or at least one spring.

4. The anti-ligature device according to claim 1, wherein the separation distance is adjustable by a user to thereby adjust a sensitivity level of the anti-ligature device.

5. The anti-ligature device according to claim 1, further comprising an alarm, wherein the alarm is activated upon the inductive proximity sensor sensing the separation distance.

6. The anti-ligature device according to claim 1, further comprising a compressible enclosure for attachment to an edge of a door leaf, wherein the inductive proximity sensor is attached to a first inner surface of the compressible enclosure, wherein the electrical conductor target is attached to a second inner surface of the compressible enclosure, such that the inductive proximity sensor opposes the electrical conductor target within the compressible enclosure.

7. The anti-ligature device according to claim 6, wherein the inductive proximity sensor is a first inductive proximity sensor and the electrical conductor target is a first electrical conductor target, the anti-ligature device further comprising a second inductive proximity sensor paired with a second electrical conductor target, wherein the second electrical conductor target is resiliently biased away from the second inductive proximity sensor, wherein the second electrical conductor target is moveable towards the second inductive proximity sensor in response to a force from a ligature on the anti- ligature device;

wherein the first inductive proximity sensor and the first electrical conductor target are positioned at a first location along a length of the compressible enclosure, wherein the second inductive proximity sensor and the second electrical conductor target are positioned at a second location along the length of the compressible enclosure, wherein the first location is spaced from the second location by a distance that is at least approximately 25% the length of the compressible enclosure.

8. An anti-ligature device comprising:

a first part having a bulbous protrusion;

a second part having a channel;

a deformable element disposed in the channel; and a plurality of proximity sensors, wherein the bulbous protrusion is inserted in the channel, wherein the deformable element biases the first part away from the second part, wherein the plurality of sensors is configured to detect a separation distance between the first part and the second part.

9. The anti-ligature device according to claim 8, wherein the proximity sensors are connected to the second part and the first part provides an inductive target for the proximity sensors.

10. The anti-ligature device according to claim 8, wherein the proximity sensors are connected to the first part and the second part provides an inductive target for the proximity sensors.

11. The anti-ligature device according to claim 8, wherein the deformable element comprises foam.

12. The anti-ligature device according to claim 8, wherein the plurality of proximity sensors is enclosed between the first part and the second part.

13. The anti-ligature device according to claim 8, wherein the channel provides a lip, wherein the lip prevents complete separation of the second part from the first part.

14. An anti-ligature device comprising:

an elongated housing configured for attachment on a door leaf;

a first pair of proximity sensor and electrical conductor target mounted in the elongated housing;

a second pair of proximity sensor and electrical conductor target mounted in the elongated housing and spaced from the first pair of proximity sensor and electrical conductor target, wherein the first and second pairs of proximity sensor and electrical conductor target are mounted in the elongated housing such that a force from a ligature applied to the elongated housing actuates at least one of the first or second pairs of proximity sensor and electrical conductor target, wherein for each of the first and second pairs of proximity sensor and electrical conductor target:

in a first, uncompressed position, the proximity sensor and the electrical conductor target are separated by a first distance in response to a resilient bias, in a second, compressed position, the proximity sensor and the electrical conductor target are separated by a second distance in response to application of the force from the ligature on the elongated housing, wherein the second distance is less than the first distance, wherein upon at least one of the first or second pairs of proximity sensor and electrical conductor target being separated by the second distance, the respective proximity sensor is actuated.

15. The anti-ligature device according to claim 14, wherein the first and second pairs of proximity sensor and electrical conductor target are arranged in the elongated housing, such that application of the force from the ligature on the elongated housing at any location along the elongated housing will actuate at least one of the proximity sensors of the first and second pairs of proximity sensor and electrical conductor target upon the respective proximity sensor and electrical conductor target being separated by the second distance.

16. The anti-ligature device according to claim 15, further comprising an alarm, wherein separation of at least one pair of proximity sensor and electrical conductor target by the second distance activates the alarm.

17. The anti-ligature device according to claim 16, wherein the second distance is adjustable by a user to thereby adjust a sensitivity level of the anti-ligature device.

18. The anti-ligature device according to claim 17, wherein (i) the electrical conductor target is moveable towards the proximity sensor in response to a force from a ligature on the electrical conductor target; (ii) the proximity sensor is moveable towards the electrical conductor target in response to a force from a ligature on the proximity sensor; or (iii) the electrical conductor target and the proximity sensor are moveable towards each other in response to a force from a ligature on either of the electrical conductor target or the proximity sensor.

19. The anti-ligature device according to claim 17, wherein the resilient bias is selected from the group consisting of: foam, and at least one spring.

20. The anti-ligature device according to claim 17, wherein each proximity sensor of the first and second pairs of proximity sensor and electrical conductor target is an inductive proximity sensor.

* * * * *